United States Patent [19]

Fukushima et al.

[11] 4,113,847

[45] Sep. 12, 1978

[54] PROCESS FOR PRODUCING CARBON FIBERS

[75] Inventors: Keitaro Fukushima; Takamaro Kusunose; Yoshinori Nosaka, all of Okayama, Japan

[73] Assignee: Japan Exlan Company Limited, Osaka, Japan

[21] Appl. No.: 719,504

[22] Filed: Sep. 1, 1976

[30] Foreign Application Priority Data

Sep. 1, 1975 [JP] Japan ..... 50-106134

[51] Int. Cl.[2] ..... C01B 31/07

[52] U.S. Cl. ..... 423/447.4; 264/29.2; 264/182; 423/447.6

[58] Field of Search ..... 264/29.2, 182; 423/447.4, 447.6; 8/115.5

[56] References Cited

U.S. PATENT DOCUMENTS

| | | | |
|---|---|---|---|
| 3,733,386 | 5/1973 | Shimoda et al. | 264/182 |
| 3,768,966 | 10/1973 | Matsumura et al. | 8/115.5 |
| 3,886,263 | 5/1975 | Shindo et al. | 8/115.5 |
| 3,917,776 | 11/1975 | Sato et al. | 423/447.5 |
| 3,954,947 | 5/1976 | Didchenko et al. | 423/447.6 |
| 3,972,984 | 8/1976 | Iizuka et al. | 423/447.6 |
| 4,001,382 | 1/1977 | Matsumura et al. | 264/29.2 |
| 4,002,426 | 1/1977 | Chenevey et al. | 264/182 |

FOREIGN PATENT DOCUMENTS

| | | | |
|---|---|---|---|
| 42-9495 | 5/1967 | Japan | 264/182 |

*Primary Examiner*—Jay H. Woo

*Attorney, Agent, or Firm*—Wenderoth, Lind & Ponack

[57] ABSTRACT

Carbon fibers are prepared by spinning a copolymer of a carboxyl group-containing unsaturated monomer and at least 85 mol% acrylonitrile, washing the filaments with water, stretching the filaments in hot acid water having a pH below 3.5, and heating the resultant fibers to cause carbonization or graphitization.

15 Claims, No Drawings

PROCESS FOR PRODUCING CARBON FIBERS

The present invention relates to an improved process for producing carbon fiber (including graphite fiber). More particularly, in producing an acrylic fiber to be used for producing carbon fiber, an acrylonitrile copolymer containing at least 85 mol % acrylonitrile and copolymerized with a carboxyl group-containing unsaturated monomer is spun into filaments in the usual way, and the filaments are washed with water and heat-stretched in hot acid water at a specific pH value, whereby an acrylonitrile fiber (precursor for carbon fiber) is prepared. Said fiber is then heated to produce carbon fiber having excellent strength and elasticity.

It is already known to obtain carbon fibers which are excellent as reinforcing materials, exothermic elements, refractory materials, etc. by heating an acrylonitrile fiber in an oxidizing atmosphere at temperatures between 200° and 400° C. so as to form a cyclized structure in the fiber, followed by heating the cyclized fiber in a non-oxidizing atmosphere at higher temperatures (normally above 800° C.).

However, the so-called thermal stabilization step, which is the step of forming naphthyridine rings in the acrylonitrile fiber by heating the fiber in an oxidizing atmosphere, is a very important step that governs the physical properties of the resulting carbon fiber, the final product. It has been considered that this step requires a long heating operation and this has been the cause of low productivity of carbon fiber.

Therefore, various processes have been proposed to accelerate the cyclization reaction so that thermally stabilized fibers can be obtained in a short time. Among these processes, a process in which a fiber of acrylonitrile copolymerized with a carboxyl group-containing unsaturated monomer is used as the precursor for producing carbon fiber is a very effective means which can shorten the heat-treatment time remarkably because the introduction of the copolymerization component lowers the exothermic transition point of the fiber and facilitates the condensation cyclization by heating. Moreover, this process can produce carbon fibers having excellent physical properties. But the acrylonitrile fiber produced by this process involves various problems with respect to its quality as a precursor for producing carbon fiber.

Namely, when producing a fiber in the usual way by spinning the above-mentioned acrylonitrile copolymer copolymerized with a carboxyl group-containing unsaturated monomer and subjecting the resulting fiber to water-washing, stretching, drying, etc., the fiber obtained causes various troubles which exert grave influences on the productivity and properties of the resulting carbon fiber, such as formation of many broken portions in single filaments, poor separability between filaments, generation of fluffs and disorder of filaments. In addition, because of poor extensibility (stretchability) of the fiber obtained by spinning, it is difficult to subject the fiber to a high ratio stretching required for acrylonitrile fibers for producing carbon fiber. Moreover, because the fiber after stretching has a high water content, it is necessary to carry out a sufficient drying operation. Thus, there are various problems in the quality and productivity of the precursor fiber.

In the light of such circumstances of the prior art, we made an intensive study to overcome the above-mentioned defects and to obtain a high quality carbon fiber in an industrially advantageous manner. As a result, we have found that, after spinning an acrylonitrile copolymer copolymerized with a carboxyl group-containing unsaturated monomer and washing the resulting fiber with water in the usual way, when the fiber is subjected to heat stretching under certain conditions and, if necessary, to steam stretching and drying, the separability between filaments is markedly improved and the filament breakage is satisfactorily prevented, and at the same time it is possible to reduce the formation of fluffs and disorder of filaments. When such acrylonitrile fiber (precursor) is heated excellent carbon fiber can be obtained within a remarkably shorter time.

The main object of the present invention is to produce, in an industrially advantageous manner, a carbon fiber having excellent physical properties.

Another object of the present invention is to advantageously produce an acrylonitrile fiber to be used for producing carbon fiber, which has good separability between filaments and has no breakage in single filaments and few fluffs and little disorder of filaments, so that carbon fiber with excellent strength and elasticity can be advantageously produced therefrom.

Another object of the present invention is to produce, at a high production efficiency and improved operativity, carbon fiber by heating an acrylonitrile fiber prepared by employing particular stretching under particular conditions.

Other objects of the present invention will become apparent from the following concrete description of the invention.

These objects of the present invention are attained by stretching filaments, which have been spun from an acrylonitrile copolymer containing at least 85 mol % acrylonitrile copolymerized with a carboxyl group-containing unsaturated monomer and washed with water in the usual way, in hot water above 80° C., maintained at a pH below 3.5, and if necessary subjecting the filaments to steam stretching and drying, to prepare an acrylonitrile fiber, which is then heated in the usual manner for carbonization or graphitization.

By following the process of the present invention, the swelling of the fiber at the time of heat stretching is markedly suppressed and the entanglement and fusion-adhesion between single filaments are satisfactorily controlled, so that the separability between the filaments is remarkably improved, the breakage of single filaments during the process is successfully prevented and problems such as the formation of fluffs and the disorder of filaments are eliminated. This makes it possible to produce high quality precursor fibers for producing carbon fiber continuously and in a good working condition. Moreover, the attainment of the high-stretching operation required for a precursor fiber for producing carbon fiber remarkably elevates the importance of the present invention. In addition, by the adoption of a heat stretching operation in an acid medium according to the present invention, the water content of the fiber is greatly lowered, so that the subsequent drying operation becomes very easy. Also, the worsening of separability between filaments, breakage of single filaments, the formation of fluffs, the disorder of filaments, etc. caused by the subsequent process steps are satisfactorily prevented.

The acrylonitrile copolymers used in the present invention are copolymers containing at least 85 mol % acrylonitrile, preferably not less than 90 mol % acrylonitrile, which has been copolymerized with a carboxyl group-containing unsaturated monomer. The carboxyl group-containing monomer is contained in said copolymer generally in the ratio of 0.1 to 10 mol %, preferably 0.5 to 5 mol %. Where the copolymerization ratio of the carboxyl group-containing unsaturated monomer is less than 0.1 mol %, it is difficult to expect shortening of the heat treatment time and elevation of the physical properties. Also, where the copolymerization ratio is in excess of 10 mol %, it is difficult to produce an acrylonitrile fiber having satisfactory physical properties required for a precursor fiber for producing carbon fiber, and moreover the physical properties of the resulting carbon fiber cannot be sufficiently improved.

The carboxyl group-containing unsaturated monomers to be copolymerized with acrylonitrile include acrylic acid, methacrylic acid, ethacrylic acid, crotonic acid, isocrotonic acid, itaconic acid, maleic acid, mesaconic acid, citraconic acid, and their water-soluble salts (alkali-metal salts and ammonium salts).

If desired, 0 to 14 mol % of a different unsaturated monomer may be copolymerized together with acrylonitrile and the carboxyl group-containing unsaturated monomer. Among such different unsaturated monomers, there may be recited well-known ethylenically unsaturated compounds such as allyl alcohol, methallyl alcohol, hydroxypropylacrylonitrile, methacrylonitrile, α-methyleneglutaronitrile, isopropenyl acetate, acrylamide, dimethylaminoethyl methacrylate, vinylpyridine, vinylpyrrolidone, methyl acrylate, methyl methacrylate, vinyl acetate, allyl chloride, sodium methallylsulfonate, potassium p-styrenesulfonate, etc. These acrylonitrile copolymers are produced generally by the well-known polymerization processess such as solvent polymerization, mass polymerization, emulsion polymerization or suspension polymerization. The solvents used for producing acrylonitrile fibers from these copolymers include organic solvents such as dimethylformamide, diemthylacetamide and dimethyl sulfoxide; and inorganic solvents such aqueous solutions of nitric acid, zinc chloride and thiocyanates. Such a copolymer solution may be spun to form filaments in the usual way.

As the spinning processes to be employed in the present invention, there may be recited all spinning processes used for producing ordinary acrylonitrile fibers, but it is preferable that the fiber is produced by the wet spinning process, or the dry-wet spinning process which comprises extruding a spinning polymer solution into an inert gas atmosphere and then into an aqueous coagulating bath to coagulate it into filaments.

After forming filaments from the acrylonitrile copolymer solution by which a spinning process, the formed fiber is subjected to water-washing to remove the solvent contained in the fiber, or, according to need, to a treatment with an acid medium, and thereafter subjected to a heat stretching operation to orient the molecules in the fiber. In the present invention, the heat stretching is performed in hot acid water having a pH below 3.5, preferably not higher than 3.0. If the stretching is performed in hot water having a pH exceeding 3.5, it becomes difficult to attain the expected objects of the present invention. It is necessary that the temperature of the hot acid water in the stretching operation should be generally above 80° C., preferably not lower than 90° C. The pH of the heat stretching bath can be adjusted by adding an inorganic or organic acid, and generally nitric acid, sulfuric acid, or phosphoric acid is advantageously used, since they are difficult to volatilize under the stretching temperature conditions. The stretching ratio may be varied over a wide range depending on the polymer composition, spinning conditions, etc. Although a precise definition of the stretching ratio is difficult, generally a stretching ratio above about two times is adopted, with an upper limit of about 8 times.

The fiber subjected to such heat stretching treatment has the above-mentioned features of the present invention, and therefore can be directly supplied as a precursor fiber to be used for producing carbon fibers, but it is supplied as a precursor generally after it has further been subjected to such operations as steam stretching, drying, etc. according to need. The steam stretching is performed in steam heated to a temperature normally not lower than about 110° C. at a stretching ratio not lower than about 1.2 times, and it is usual that the total stretching ratio resulting from the steam stretching plus the above-mentioned heat stretching amounts to about 4 to 20 times. Also, it is permissible to treat the fiber with an oiling agent before the drying operation or to subject the fiber to a heat treatment after the drying operation.

Thus, by adopting the process of the present invention, it has become possible to produce an acrylic fiber for producing carbon fiber continuously and in a good working condition, which has good separability between filaments and has no breakage in single filaments and few fluffs and little disorder of filaments. Accordingly, by subjecting such a high quality acrylonitrile fiber to heat treatment, it has become possible to produce carbon fibers excellent in strength and modulus of elasticity, at a high production efficiency and in a short time, without any trouble in the heat treatment step.

In producing carbon fiber from the thus-obtained acrylonitrile fiber, any known heat treating process may be employed. However, generally, a process is advantageously employed which comprises a primary heat treating step (the so-called thermal stabilization step) in which the fiber is heated to 150° to 400° C. in an oxidizing atmosphere to form a cyclized structure of naphthyridine rings, and a secondary heat treating step in which the thermally stabilized fiber is heat treated in a non-oxidizing atmosphere or under reduced pressure at a higher temperature (generally above 800° C. and in the case of graphitization a temperature above 2000° C.) to carbonize or graphitize it. Although air is preferred as the thermal stabilization atmosphere, the fiber may be thermally stabilized in the presence of hydrogen chloride gas, sulfur dioxide gas or nitrogen monoxide gas or under irradiation of light. The temperature for the carbonization is generally 800°-2000° C. and the resulting carbon fiber may be further heated to 2000°-3500° C. for the graphitization. As the carbonizing or graphitizing atmosphere, nitrogen, helium, argon, etc. are preferred. To produce a carbon fiber having a higher tensile strength and modulus of elasticity, it is preferred to heat the fiber under tension as is generally known. It is particularly effective to apply tension at the time of thermal stabilization and carbonization or graphitization. The carbonization or graphitization may be carried out under reduced or increased pressure.

For a better understanding of the present invention, representative examples of the invention are set forth in the following. In the examples, percentages and parts are by weight unless otherwise specified.

EXAMPLE 1

A spinning solution obtained by dissolving 15 parts of an acrylonitrile copolymer consisting of 98% acrylonitrile and 2% methacrylic acid in 85 parts of a 53% aqueous solution of sodium thiocyanate, was extruded into air through a spinnerette having 1500 orifices, each 0.15 mm. in diameter, and was then introduced into a 12% aqueous solution of sodium thiocyanate to coagulate it into filaments. After the thus-obtained fiber was washed thoroughly with water, it was heat-stretched 3.2 times its length in hot water at 98° C., maintained at the various pH values shown in Table 1 with nitric acid, and then it was further subjected to a 2.5 times stretching in superheated steam at 144° C. Thereafter, the fiber was dried for 3 seconds with rollers heated to 150° C. In this way, an acrylic fiber having a single-filament fineness of about 1.3 denier was obtained. Breakage of single filaments and the water content of the fiber before drying under the various production conditions were measured, and also the separability between filaments of the obtained fibers was evaluated. The results are shown in Table 1. Further, the maximum stretching ratio at each pH value was obtained to compare the extensibility.

As apparent from the results in Table 1, in the case of Experiments A, B and C in which the hot stretching bath is maintained at a pH below 3.5, there was no breakage of single filaments during the process, and the stretchability was improved. In addition acrylic fibers having good separability between filaments were obtained and the drying operation became easy because of the low water content before drying. On the other hand, in the case of using a higher pH heat stretching bath (Experiments D and E), or in the case where the pH of the heat stretching bath was not controlled (Experiment F), breakage of single filaments took place, the stretchability was low and the separability between filaments was poor, so that the fibers were undesirable as precursor fibers for producing carbon fibers.

Table 1

| Experiment | A | B | C | D | E | F |
|---|---|---|---|---|---|---|
| pH of heat stretching bath | 1 | 2 | 3 | 4 | 5 | Blank |
| Breakage of single filaments (times/day) | 0 | 0 | 0 | 5 | 10 | 12 |
| Maximum stretching ratio | 5.5 | 5.4 | 5.4 | 4.8 | 4.5 | 4.4 |
| Water content before drying (%) | 68 | 70 | 72 | 91 | 95 | 102 |
| Separability between filaments | ← | Good | → | ← | Poor | → |

Each of the acrylic fibers obtained in Experiments A, B and C was continuously passed under an air atmosphere through an electric furnace having a continuous temperature gradient from 200° to 280° C., spending 25 minutes for thermal stabilization, and then continuously passed under a nitrogen atmosphere through an electric furnace having a continuous temperature gradient from 300° C. to 1300° C., spending about 2 minutes for carbonization. The strength and the modulus of elasticity of each carbon fiber thus obtained were: in the case of using the Experiment A fiber 340 kg/mm$^2$ and 24.6 ton/mm$^2$; in the case of using the Experiment B fiber 333 kg/mm$^2$ and 25.2 ton/mm$^2$; and in the case of using the Experiment C fiber 320 kg/mm$^2$ and 25.0 ton/mm$^2$, respectively. Thus, these carbon fibers had excellent physical properties.

On the other hand, when the fibers obtained in Experiments D, E and F were heat-treated under the above-mentioned conditions, all the fibers caused breakage of filaments during the carbonization step after the thermal stabilization treatment, and it was impossible to obtain carbon fiber. Therefore, the heat treatment operation was repeated, with the final temperature and the time required for passing through the electric furnace in the thermal stabilization treatment changed to 290° C. and 28 minutes, respectively. In the case of using the Experiment D fiber, a carbon fiber having a strength of 302 kg/mm$^2$ and a modulus of elasticity of 24.2 ton/mm$^2$ was obtained, and in the case of using the Experiment F fiber, a carbon fiber having a strength of 283 kg/mm$^2$ and a modulus of elasticity of 22.3 ton/mm$^2$ was obtained. Thus, both were inferior in the physical properties in comparison with the carbon fibers obtained using the acrylic fibers according to the process of the present invention.

EXAMPLE 2

An acrylonitrile fiber was obtained by water-washing the coagulated filaments obtained in Example 1, treating the filaments in an acid medium at pH 1, heat-stretching the filaments 3.2 times their length in boiling water while controlling the pH of the boiling water at 2.5, further stretching the filaments 2.5 times in superheated steam at 139° C. and drying the filaments for 3 minutes with rollers heated to 150° C. In this production process, there was no substantial breakage of single filaments and therefore continuous operation could be performed. The separability between filaments of the obtained fiber was very good, and fluffs of single filaments and disorder of filaments were hardly observed. Thus the fiber had excellent properties as a precursor fiber for producing carbon fiber.

On the other hand, when the pH of the heat stretching bath was not controlled at all in the above fiber production process, the pH of the heat stretching bath reached 4.8. Breakage of single filaments occurred at the rate of 9 times per day and it was difficult to carry out continuous operation. The fiber obtained was poor in separability between filaments and had fluffs of single filaments and disorder of filaments. Therefore the fiber did not have satisfactory qualities as a precursor fiber for producing carbon fiber.

Each of the acrylonitrile fibers prepared by controlling the pH of the heat-stretching bath to 2.5 as above and by not controlling the pH as above was subjected to the thermal-stabilization and carbonization treatments in the same manner as in Example 1. In case of the former (heat-stretching bath pH was adjusted to 2.5) the resulting carbon fiber had a strength of 330 kg/mm$^2$ and a modulus of elasticity of 25.1 ton/mm$^2$, but in case of the latter (heat-stretching bath pH was not adjusted) filament breakage occurred at the carbonization step and satisfactory carbon fiber could not be obtained.

What we claim is:

1. A process for producing carbon fibers, which comprises spinning a copolymer containing at least 85 mol % acrylonitrile and a carboxyl group-containing unsaturated monomer into filaments, washing the filaments with water, stretching the washed filaments in water above 80° C. maintained at a pH below 3.5, drying the stretched filaments thermally stabilizing the dried filaments, and carbonizing, or carbonizing and graphitizing, the stabilized filaments.

2. A process as claimed in claim 1 wherein, after the stretching, the filaments are subjected to steam stretching and drying.

3. A process as claimed in claim 1 wherein the copolymer contains at least 90 mol % of acrylonitrile.

4. A process as claimed in claim 1 wherein the copolymer contains 0.1–10 mol % of the carboxyl group-containing unsaturated monomer.

5. A process as claimed in claim 1 wherein the copolymer contains 0.5–5 mol % of the carboxyl group-containing unsaturated monomer.

6. A process as claimed in claim 1 wherein the stretching is conducted in water maintained at a pH not higher than 3.0.

7. A process as claimed in claim 1 wherein the stretching is conducted in water at a temperature not lower than 90° C.

8. A process as claimed in claim 1 wherein the stretching is conducted at a stretch ratio of 2–8 times.

9. A process as claimed in claim 2 wherein the steam stretching is conducted at a temperature not lower than 110° C. and at a stretch ratio of not lower than 1.2 times.

10. A process as claimed in claim 1 wherein the dried filaments are thermally stabilized by heating the filaments in an oxidizing atmosphere at a temperature of from 150° C. to 400° C., and the stabilized filaments are carbonized, or carbonized and then graphitized, in a non-oxidizing atmosphere at a temperature above 800° C.

11. A process as claimed in claim 10 wherein the filaments are thermally stabilized under tension.

12. A process as claimed in claim 10 wherein the stabilized filaments are carbonized, or carbonized and then graphitized, under tension.

13. A process as claimed in claim 10 wherein the oxidizing atmosphere is air.

14. A process as claimed in claim 10 wherein the stabilized filaments are carbonized in a non-oxidizing atmosphere at a temperature of from 800° C. to 2000° C. and then graphitized in a non-oxidizing atmosphere at a temperature of from 2000° C. to 3500° C.

15. A process as claimed in claim 10 wherein the non-oxidizing atmosphere is nitrogen.

* * * * *